US011617249B2

(12) United States Patent
Ye et al.

(10) Patent No.: US 11,617,249 B2
(45) Date of Patent: Mar. 28, 2023

(54) LIGHTING APPARATUS

(71) Applicant: XIAMEN LEEDARSON LIGHTING CO., LTD, Fujian (CN)

(72) Inventors: Hemu Ye, Fujian (CN); Liping Lin, Fujian (CN); Wei Liu, Fujian (CN)

(73) Assignee: XIAMEN LEEDARSON LIGHTING CO., LTD, Fujian (CN)

( * ) Notice: Subject to any disclaimer, the term of this patent is extended or adjusted under 35 U.S.C. 154(b) by 0 days.

(21) Appl. No.: 17/382,542

(22) Filed: Jul. 22, 2021

(65) Prior Publication Data

US 2022/0030688 A1 Jan. 27, 2022

(30) Foreign Application Priority Data

Jul. 22, 2020 (CN) ..... 202021455361.2

(51) Int. Cl.
*H05B 45/28* (2020.01)
*H05B 45/50* (2022.01)
*H05B 45/325* (2020.01)

(52) U.S. Cl.
CPC ..... *H05B 45/50* (2020.01); *H05B 45/28* (2020.01); *H05B 45/325* (2020.01)

(58) Field of Classification Search
None
See application file for complete search history.

(56) References Cited

U.S. PATENT DOCUMENTS 10,517,164 B1 * 12/2019 Charles ..... H05B 47/19
2015/0155743 A1 * 6/2015 Noguchi ..... H02J 9/065 307/23
2021/0381681 A1 * 12/2021 Lin ..... H05B 47/155

FOREIGN PATENT DOCUMENTS

JP 2015232990 A * 12/2015

* cited by examiner

*Primary Examiner* — Dedei K Hammond
(74) *Attorney, Agent, or Firm* — Chun-Ming Shih; Lanway IPR Services

(57) ABSTRACT

A lighting apparatus includes a power circuit, multiple light sources, a power failure detection circuit, a wall switch decoder and a controller. The power circuit converts an external power source to multiple driving currents. The multiple light sources respectively receive the multiple driving currents to generate a required mixed light. The power failure detection circuit is coupled to the power circuit for detecting a predetermined power failure pattern. When the predetermined power failure pattern is detected, the power failure detection circuit generates a failure signal. The wall switch decoder is coupled to a wall switch via a signal wire for converting a manual operation to a corresponding switch parameter. The failure signal activates a mode switch in the controller to select a working mode. The switch parameter is interpreted with different setting instructions under different working modes.

17 Claims, 4 Drawing Sheets

LIGHTING APPARATUS

FIELD

The present invention is related to a lighting apparatus, and more particularly related to a lighting apparatus with a smart switch function.

BACKGROUND

The time when the darkness is being lighten up by the light, human have noticed the need of lighting up this planet. Light has become one of the necessities we live with through the day and the night. During the darkness after sunset, there is no natural light, and human have been finding ways to light up the darkness with artificial light. From a torch, candles to the light we have nowadays, the use of light have been changed through decades and the development of lighting continues on.

Early human found the control of fire which is a turning point of the human history. Fire provides light to bright up the darkness that have allowed human activities to continue into the darker and colder hour of the hour after sunset. Fire gives human beings the first form of light and heat to cook food, make tools, have heat to live through cold winter and lighting to see in the dark.

Lighting is now not to be limited just for providing the light we need, but it is also for setting up the mood and atmosphere being created for an area. Proper lighting for an area needs a good combination of daylight conditions and artificial lights. There are many ways to improve lighting in a better cost and energy saving. LED lighting, a solid-state lamp that uses light-emitting diodes as the source of light, is a solution when it comes to energy-efficient lighting. LED lighting provides lower cost, energy saving and longer life span.

The major use of the light emitting diodes is for illumination. The light emitting diodes is recently used in light bulb, light strip or light tube for a longer lifetime and a lower energy consumption of the light. The light emitting diodes shows a new type of illumination which brings more convenience to our lives. Nowadays, light emitting diode light may be often seen in the market with various forms and affordable prices.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

In 1878, Thomas Edison tried to make a usable light bulb after experimenting different materials. In November 1879, Edison filed a patent for an electric lamp with a carbon filament and keep testing to find the perfect filament for his light bulb. The highest melting point of any chemical element, tungsten, was known by Edison to be an excellent material for light bulb filaments, but the machinery needed to produce super-fine tungsten wire was not available in the late 19th century. Tungsten is still the primary material used in incandescent bulb filaments today.

Early candles were made in China in about 200 BC from whale fat and rice paper wick. They were made from other materials through time, like tallow, spermaceti, colza oil and beeswax until the discovery of paraffin wax which made production of candles cheap and affordable to everyone. Wick was also improved over time that made from paper, cotton, hemp and flax with different times and ways of burning. Although not a major light source now, candles are still here as decorative items and a light source in emergency situations. They are used for celebrations such as birthdays, religious rituals, for making atmosphere and as a decor.

Illumination has been improved throughout the times. Even now, the lighting device we used today are still being improved. From the illumination of the sun to the time when human can control fire for providing illumination which changed human history, we have been improving the lighting source for a better efficiency and sense. From the invention of candle, gas lamp, electric carbon arc lamp, kerosene lamp, light bulb, fluorescent lamp to LED lamp, the improvement of illumination shows the necessity of light in human lives.

There are various types of lighting apparatuses. When cost and light efficiency of LED have shown great effect compared with traditional lighting devices, people look for even better light output. It is important to recognize factors that can bring more satisfaction and light quality and flexibility.

Current light devices are usually controlled by wall switches. However, the wall switch usually is used for adjusting a light intensity of the light device.

It is beneficial if the wall switch may be enhanced to provide further functions on controlling the light devices.

SUMMARY

In some embodiments, a lighting apparatus includes a power circuit, multiple light sources, a power failure detection circuit, a wall switch decoder and a controller.

The power circuit converts an external power source to multiple driving currents. For example, a 110V AC power is converted to multiple DC currents. The driving currents may be provided alternatively over time.

The multiple light sources respectively receive the multiple driving currents to generate a required mixed light.

The power failure detection circuit is coupled to the power circuit for detecting a predetermined power failure pattern.

When the predetermined power failure pattern is detected, the power failure detection circuit generates a failure signal.

The wall switch decoder coupled to a wall switch via a signal wire for converting a manual operation to a corresponding switch parameter.

The controller is coupled to the power circuit, the power failure detection circuit and the wall switch decoder.

The failure signal activates a mode switch in the controller to select a working mode.

The switch parameter is interpreted with different setting instructions under different working modes.

In some embodiments, where the multiple light sources are LED modules with different color temperatures.

In some embodiments, at least one working mode is to associate the switch parameter to adjust a light intensity of one light source.

In some embodiments, at least one working mode is to associate the switch parameter to a mixed color temperature of the required mixed light and a sum of the multiple driving currents is varied according to the switch parameter at the same time.

In some embodiments, at least one working mode is to associate the switch parameter to a mixed color temperature of the required mixed light but a sum of the multiple driving currents is kept the same.

In some embodiments, the lighting apparatus may also include a speaker coupled to the power circuit.

At least one working mode is to associate the switch parameter to a volume of the speaker.

In some embodiments, a predetermined power failure pattern is a power frequency pattern detected from the power circuit.

In some embodiments, the controller sends multiple PWM signals to the power circuit to change the multiple driving currents.

In some embodiments, the controller has a memory to record a status of the working mode.

In some embodiments, the controller further sends the working parameter to another lighting apparatus via a wireless protocol.

In some embodiments, the controller sends the working mode to said another lighting apparatus.

In some embodiments, said another lighting apparatus does not have the wall switch decoder.

In some embodiments, the lighting apparatus may also include the wall switch to couple to the power circuit.

In some embodiments, the wall switch has a user interface, an interface decoder and a 0-10V dimmer circuit.

The interface decoder translates a user operation to an interface signal transmitted via the 0-10V dimmer circuit.

In some embodiments, the interface signal includes setting an identifier of the controller.

In some embodiments, the interface decoder sends a wireless command corresponding to the user operation to an external device.

In some embodiments, the interface decoder includes an NFC receiver for receiving a Wi-Fi setting from an external device, the Wi-Fi setting is sent to the controller.

In some embodiments, the controller ignores the power failure detection circuit when the wall switch decoder fails to detect the wall switch.

In some embodiments, a backup battery is coupled to the power circuit. The backup batter is activated by the controller when the power failure detection circuit detects an emergency power off condition.

In some embodiments, the controller performs the mode switch when the wall switch is a simple on/off switch.

DETAILED DESCRIPTION

Figure 4:
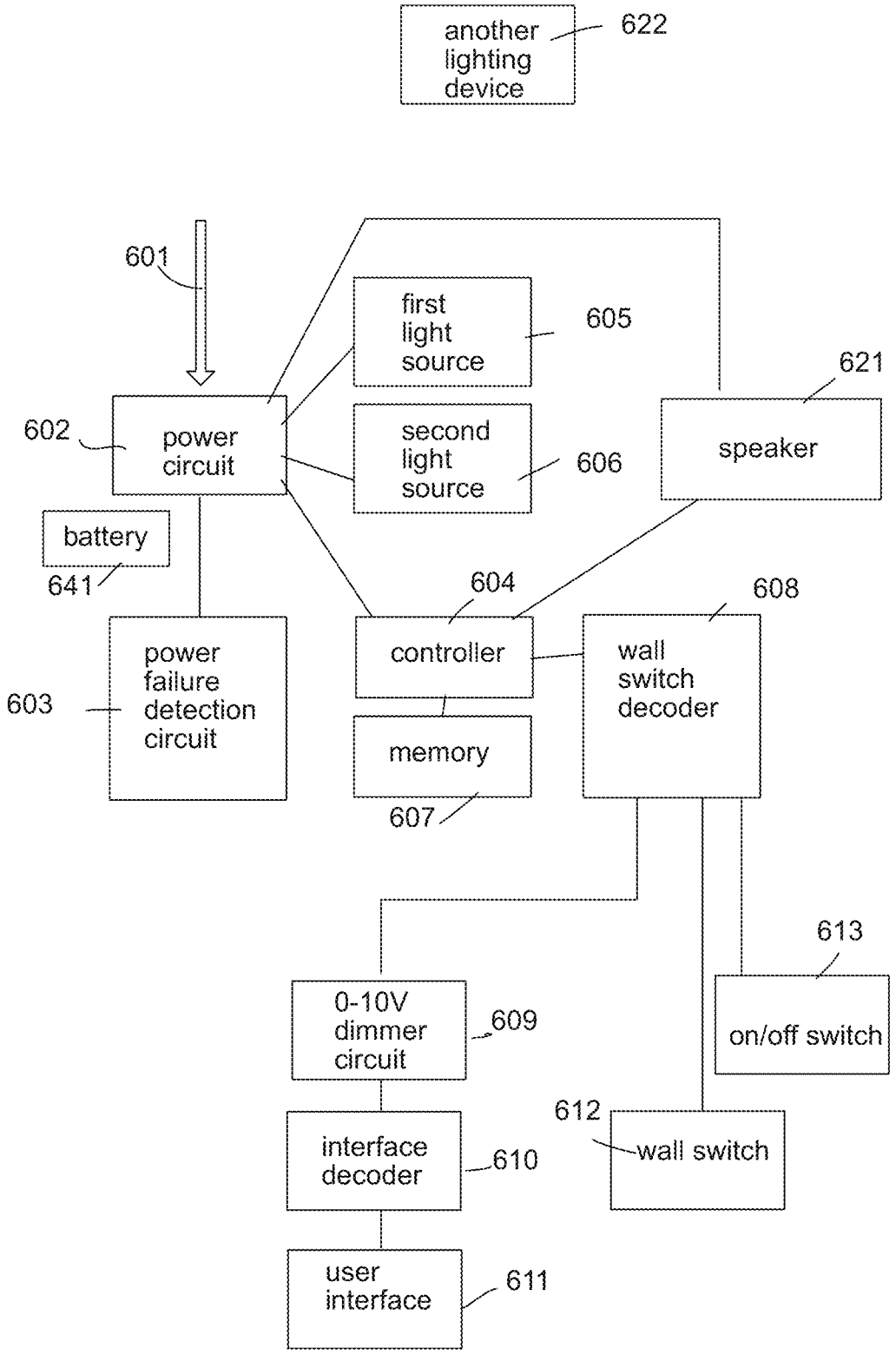
FIG. 4 shows another embodiment of a lighting apparatus.

In FIG. 4, a lighting apparatus includes a power circuit 602, multiple light sources like a first light source 605 and a second light source 606, a power failure detection circuit 603, a wall switch decoder 608 and a controller 604.

The controller 604 may be a microcontroller that is able to execute program code or an ASIC chip encoded with hardware logic for performing following functions. The controller 604 may further be coupled to a memory 607. An operation status or settings may be stored in the memory.

The power circuit 602 converts an external power source to multiple driving currents. For example, a 110V AC power is converted to multiple DC currents. The driving currents may be provided alternatively over time. For example, a constant current is generated by the power circuit but alternatively supplied to the first light source 605 and the second light source 606 alternatively over time.

The multiple light sources respectively receive the multiple driving currents to generate a required mixed light. For example, the first light source 605 generates a light with main color temperature of 2700K and the second light source 606 generates a light with main color temperature of 5000K. The controller 604 instructs the power circuit 602 to generate different driving currents to the first light source 605 and the second light source 606 to mix different color temperatures.

The power failure detection circuit 603 is coupled to the power circuit 602 for detecting a predetermined power failure pattern. For example, the power circuit has multiple components and generate a power signal with a frequency pattern. The power failure detection circuit 603 includes electronic components to convert the frequency pattern to a detection signal. The detection signal may be a digital signal indicating whether the power failure patter exists or an analog signal to be further processed by the controller 604.

When the predetermined power failure pattern is detected, the power failure detection circuit generates a failure signal.

The wall switch decoder 608 is coupled to a wall switch 612 via a signal wire for converting a manual operation to a corresponding switch parameter. For example, the wall switch is a 0-10V dimmer switch mounted on a wall. The 0-10V dimmer switch generates a 0-10V signal corresponding a manual switch like a rotation switch to be operated by a user.

The controller 604 is coupled to the power circuit 602, the power failure detection circuit 603 and the wall switch decoder 608.

The failure signal activates a mode switch in the controller 604 to select a working mode. For example, when a failure signal is detected, the controller 604 starts a counting process. IF the failure signal disappears within a second, the controller 604 may determine that the wall switch 612 is operated by a user trying to activate the mode switch.

The mode switch is a process that the controller 604 to change a different way to interpret the signal received from the wall switch, e.g. a rotation angle of a rotation switch. Users may turn off by rotating the rotation switch to a OFF position and quickly rotate to a desired position. The controller 604 detects the failure signal first and then enters the mode switch process. If there are three modes, each time users quickly turns of and turns off the wall switch 612, a mode switch is activated and a next mode is selected. The controller 604 stores the current mode and uses the current mode to interpret the operation of the wall switch, e.g. a rotation position of a 0-10V dimmer.

The switch parameter is interpreted with different setting instructions under different working modes.

In some embodiments, where the multiple light sources are LED modules with different color temperatures.

In some embodiments, at least one working mode is to associate the switch parameter to adjust a light intensity of one light source.

For example, a first mode may be used for changing a light intensity of the first light source 605. A second mode may be used for changing a light intensity of the second light source 606.

In some embodiments, at least one working mode is to associate the switch parameter to a mixed color temperature of the required mixed light and a sum of the multiple driving currents is varied according to the switch parameter at the same time.

A third mode may be used for changing a mixed color temperature and meanwhile change the overall intensity unchanged, e.g. the sum of the driving currents supplied to the first light source 605 and the second light source 606. For example, to simulate a sunset light, the intensity and the color temperature are adjusted at the same time.

In some embodiments, at least one working mode is to associate the switch parameter to a mixed color temperature of the required mixed light but a sum of the multiple driving currents is kept the same.

A fourth mode may be used for changing a mixed color temperature but kept the overall intensity unchanged, e.g. the sum of the driving currents supplied to the first light source 605 and the second light source 606.

In some embodiments, the lighting apparatus may also include a speaker 621 coupled to the power circuit 602.

At least one working mode is to associate the switch parameter to a volume of the speaker. For example, the 0-10V dimmer is now used in this mode to change a volume of the speaker to be played by the speaker 621.

In some embodiments, a predetermined power failure pattern is a power frequency pattern detected from the power circuit. For example, a 40 Hz power signal frequency is detected with a filter and an analog to digital converter to generate a high or low voltage signal supplied to the controller 604.

Persons of ordinary skilled in the art would know how to design a power failure detection circuit depending on the topology of the power circuit 602 and details thus are not repeated here for brevity.

In some embodiments, the controller 604 sends multiple PWM signals to the power circuit to change the multiple driving currents. PWM is a known technology using Pulse Width Modulation to adjust an accumulated current over time.

In some embodiments, the controller 604 has a memory 607 to record a status of the working mode. For example, the controller 604 keeps the current mode in the memory 607. Even the lighting apparatus is turned off. Next time, when users start to operate the manual switch 612, the controller 604 uses the previous mode to interpret the operation of the wall switch 612 unless the wall switch is used for activating a mode switch process, e.g. quickly turn off and turn on within a second.

In some embodiments, the controller 604 further sends the working parameter to another lighting apparatus 622 via a wireless protocol, e.g. a Wi-Fi, Zig-bee or other communication protocol.

In such design, the another lighting device 622 may be controlled by the wall switch 612 at the same time, even the another lighting device 622 is not directly connected to the wall switch 612. This is particularly helpful when there are multiple of lighting devices installed in a room. People would like to operate all lighting devices in the room at the same time, instead of operating the wall switch 612 for each lighting device separately.

The controller 604 may be integrated with a wireless circuit for sending instructions to the another lighting device 622.

In some embodiments, the controller sends the working mode to said another lighting apparatus. In addition to the setting, the working mode may also be sent to the another lighting device 622.

In some embodiments, said another lighting apparatus does not have the wall switch decoder. In such case, even the lighting apparatus does not have the wall switch decoder or the power failure detection circuit, the another lighting device 622 may still be operated at the same time.

In some embodiments, the lighting apparatus may also include the wall switch to couple to the power circuit. In such case, the manufacture may provide the wall switch at the same time to a user. In some other embodiments, users may use original wall switches.

In some embodiments, the wall switch has a user interface 611, an interface decoder 610 and a 0-10V dimmer circuit 609.

The interface decoder 610 translates a user operation on the interface 611 to an interface signal transmitted via the 0-10V dimmer circuit 609.

For example, the user interface 611 may be a complicated touch panel, instead of a traditional rotation 0-10V dimmer. However, the interface decoder 610 translates the operation on the user interface 611 to a command compatible with the 0-10V dimmer to be sent to the controller 604 by the 0-10V dimmer circuit 609.

When users uses such device, more functions may be provided. For example, the user interface 611 may provide four buttons to be selected corresponding to the four modes mentioned above. When the button is pressed, an off-on within one second to activate the mode switch is generated by the interface decoder for the 0-10V dimmer circuit 609 to sent to the wall switch decoder 608. In other words, users may buy an enhanced wall switch to skip the process of repeating on-off operations to change the working mode of the controller 604.

In some embodiments, the interface signal includes setting an identifier of the controller. For example, when there are multiple light devices placed in a room, it is important to arrange an identifier to a lighting device. The operation of mode change may also be used for sending data to the controller 604.

In some embodiments, the interface decoder 610, with a wireless circuit, sends a wireless command corresponding to the user operation to an external device. For example, when users operate the user interface 611, an additional wireless command is generated by the interface decoder 610 to control another lighting device 622.

In some embodiments, the interface decoder includes an NFC receiver for receiving a Wi-Fi setting from an external device, the Wi-Fi setting is sent to the controller. As mentioned above, the signal channel may also be used for transmitting encoded data.

NFC (Near Field Chip) may be used for sending data and such data are routed by the interface decoder 610 to the controller 604.

In some embodiments, the controller 604 ignores the power failure detection circuit 603 when the wall switch decoder fails to detect the wall switch. For example, when users buy such lighting apparatus but does not have a corresponding 0-10V dimmer.

In some embodiments, a backup battery 641 is coupled to the power circuit. The backup batter is activated by the controller when the power failure detection circuit detects an emergency power off condition.

In some embodiments, the controller performs the mode switch when the wall switch is a simple on/off switch 613.

Figure 1:
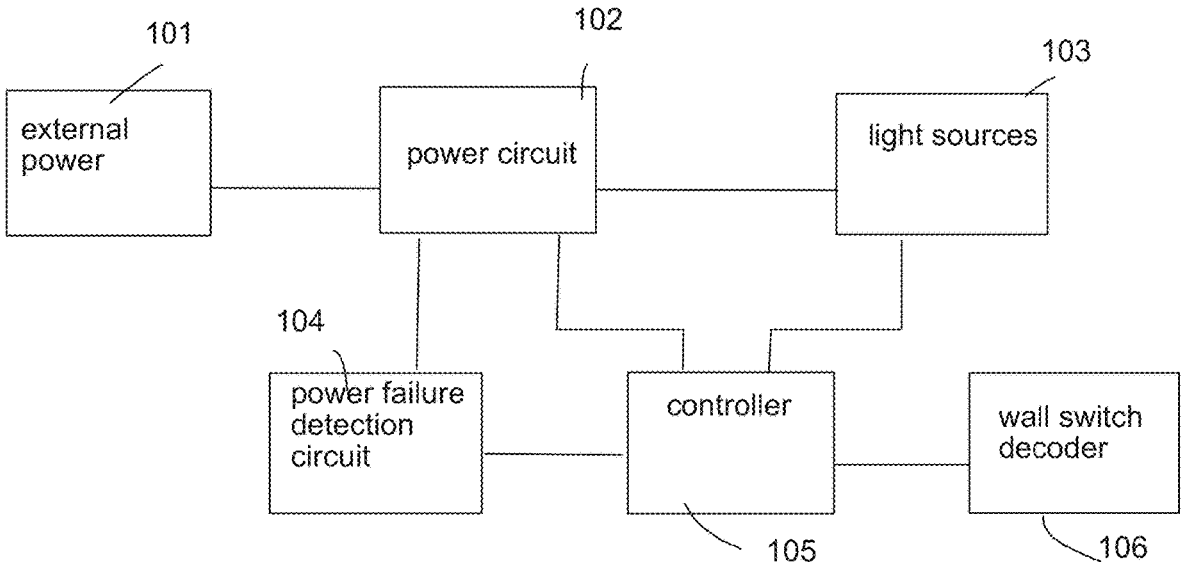
FIG. 1 illustrates a circuit diagram of a lighting apparatus embodiment.

Please refer to FIG. 1. FIG. 1 shows another embodiment.

In FIG. 1, the lighting apparatus has a power circuit 102 receiving an external power 101 to generate a driving current to the light sources 103.

There is a controller 105 coupled with a power failure detection circuit 104 and a wall switch decoder 106. The controller 105, the power failure detection circuit 104 and the wall switch decoder 106 may refer to the explanation mentioned above.

Figure 2:
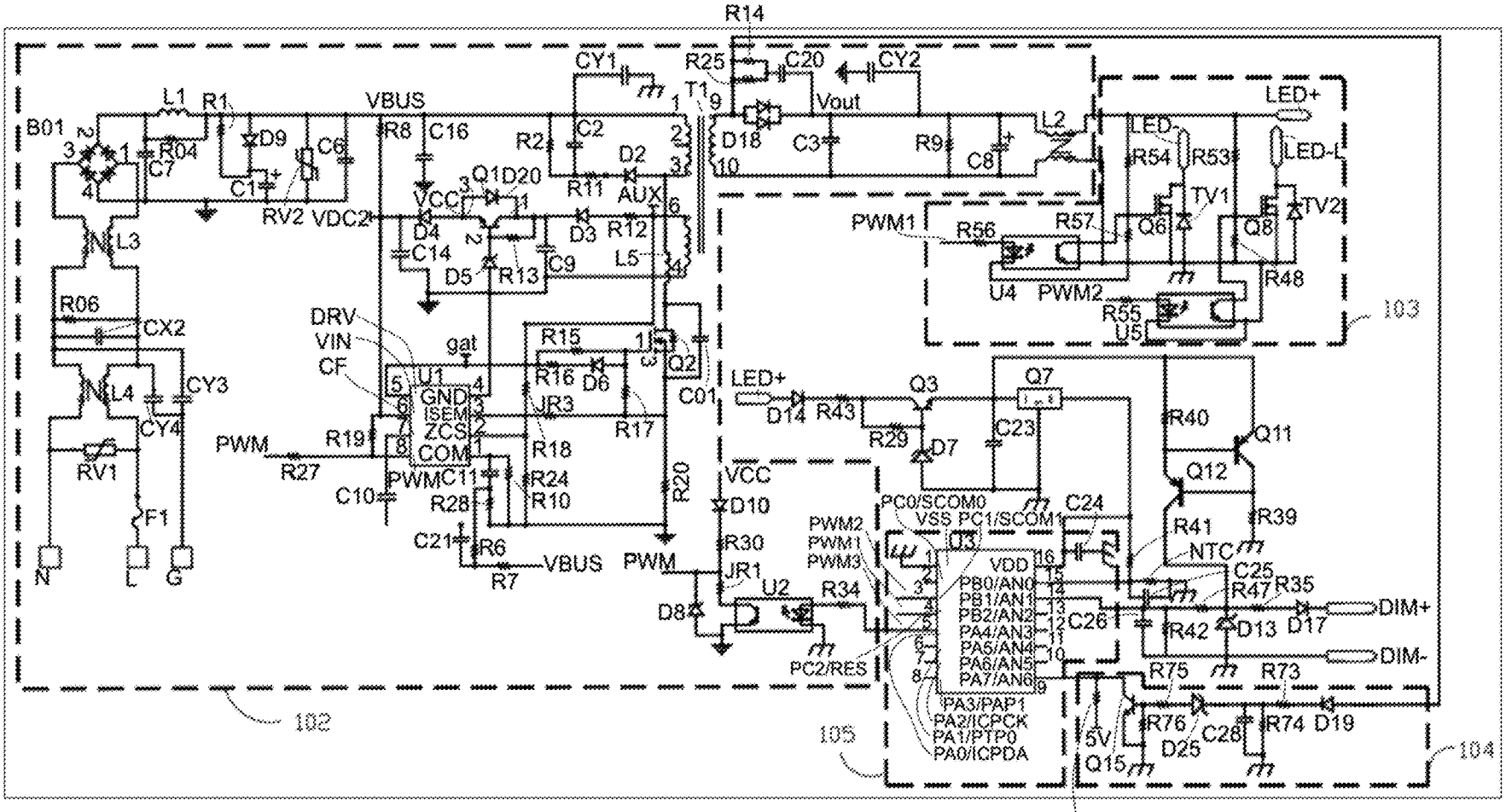
FIG. 2 illustrates a detailed circuit example for implementing an embodiment.
Figure 3:
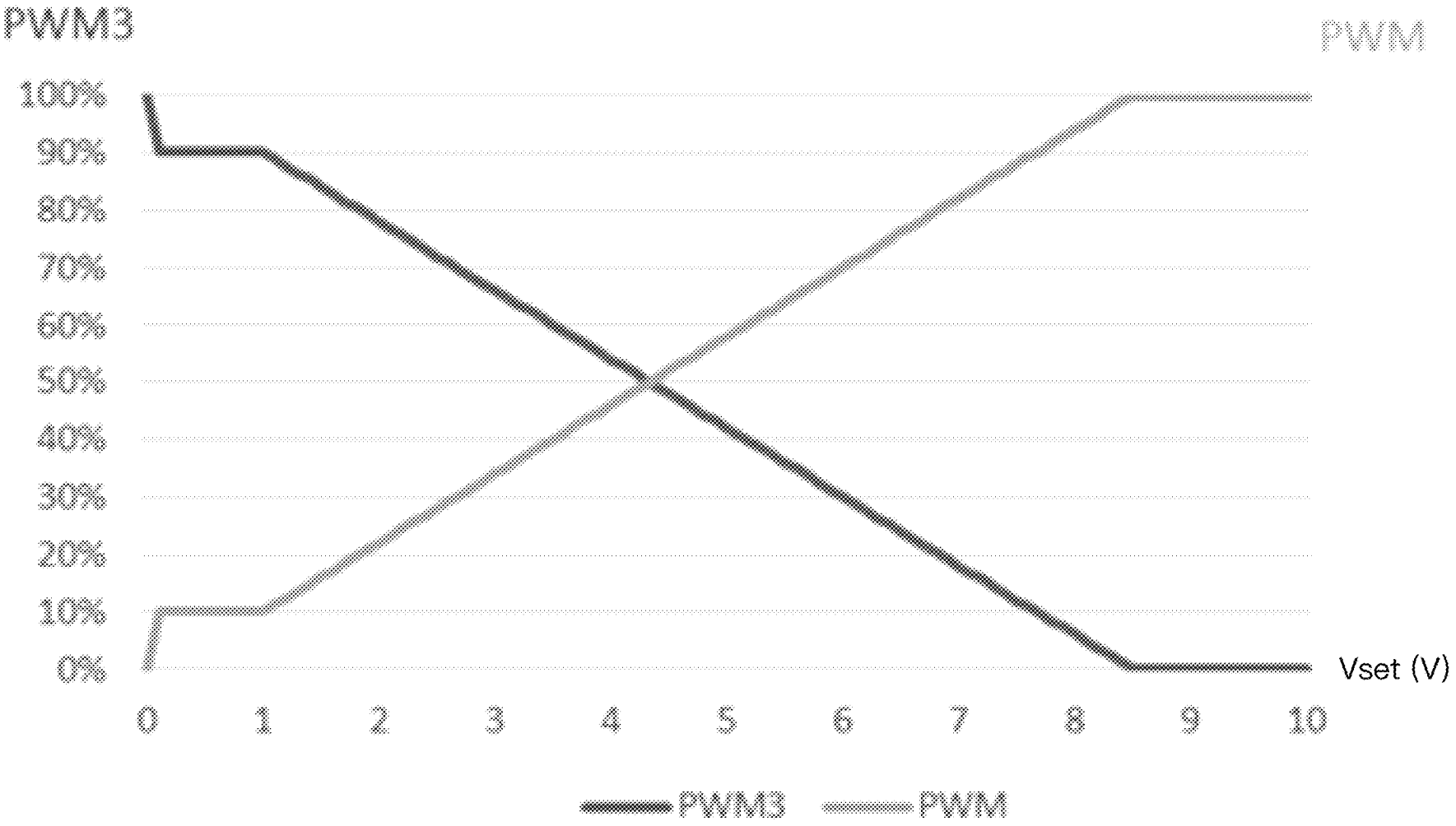
FIG. 3 illustrates a signal diagram showing relation of a setting signal and a PWM signal.

FIG. 2 shows a detailed circuit example for implementing the circuit. However, persons of ordinary skilled in the art may adjust the circuit with their knowledge on the light circuit design to make variations.

In FIG. 2, the controller 105, the power circuit 102, the power failure detection circuit 104 and the wall switch decoder 106 are marked with block borders.

In FIG. 2, there is a controller chip U3, which may be a microcontroller unit (MCU). The controller chip U3 is coupled to the power failure detection circuit 104 and the wall switch decoder 106 to perform mode switch process and to interpret the manual operation on a wall switch like a 0-10V rotation dimmer switch.

The power circuit 102 includes an optical coupler U2, a transformer T1, a control chip U1 and a field transistor Q2.

The control chip U1 is coupled to the transformer T1, the field transistor Q2 and the optical coupler U2.

The optical coupler U3 inverts the signal of the controller chip U3 to the control chip U1. The control chip U1 generates a turn-on or turn-off according to a wall switch with the field transistor Q2. The field transistor Q2 is a N-tunnel MOS transistor so that users may use the wall switch to perform multiple adjustments over different working modes.

The power circuit 102 includes a rectifier module for converting an external power source 101 to a constant driving current to the light sources 103.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus, comprising:

a power circuit for converting an external power source to multiple driving currents;

multiple light sources respectively receiving the multiple driving currents to generate a required mixed light;

a power failure detection circuit coupled to the power circuit for detecting a predetermined power failure pattern, wherein when the predetermined power failure pattern is detected, the power failure detection circuit generates a failure signal;

a wall switch decoder coupled to a wall switch via a signal wire for converting a manual operation to a corresponding switch parameter; and a controller coupled to the power circuit, the power failure detection circuit and the wall switch decoder, wherein the failure signal activates a mode switch in the controller to select a working mode, the switch parameter is interpreted with different setting instructions under different working modes, wherein a wall switch is coupled to the power circuit, wherein the wall switch has a user interface, an interface decoder and a 0-10V dimmer circuit, wherein the interface decoder translates a user operation to an interface signal transmitted via the 0-10V dimmer circuit, wherein the controller further sends the working parameter to another lighting apparatus via a wireless protocol.

2. The lighting apparatus of claim 1, wherein the multiple light sources are LED modules with different color temperatures.

3. The lighting apparatus of claim 1, wherein at least one working mode is to associate the switch parameter to adjust a light intensity of one light source.

4. The lighting apparatus of claim 1, wherein at least one working mode is to associate the switch parameter to a mixed color temperature of the required mixed light and a sum of the multiple driving currents is varied according to the switch parameter at the same time.

5. The lighting apparatus of claim 1, wherein at least one working mode is to associate the switch parameter to a mixed color temperature of the required mixed light but a sum of the multiple driving currents is kept the same.

6. The lighting apparatus of claim 1, further comprising a speaker coupled to the power circuit, wherein at least one working mode is to associate the switch parameter to a volume of the speaker.

7. The lighting apparatus of claim 1, wherein a predetermined power failure pattern is a power frequency pattern detected from the power circuit.

8. The lighting apparatus of claim 1, wherein the controller sends multiple PWM signals to the power circuit to change the multiple driving currents.

9. The lighting apparatus of claim 1, wherein the controller has a memory to record a status of the working mode.

10. The lighting apparatus of claim 1, wherein the controller sends the working mode to said another lighting apparatus.

11. The lighting apparatus of claim 1, wherein said another lighting apparatus does not have the wall switch decoder.

12. The lighting apparatus of claim 1, wherein the interface signal comprises setting an identifier of the controller.

13. The lighting apparatus of claim 1, wherein the interface decoder sends a wireless command corresponding to the user operation to an external device.

14. The lighting apparatus of claim 1, wherein the interface decoder comprises an NFC receiver for receiving a Wi-Fi setting from an external device, the Wi-Fi setting is sent to the controller.

15. The lighting apparatus of claim 1, wherein the controller ignores the power failure detection circuit when the wall switch decoder fails to detect the wall switch.

16. The lighting apparatus of claim 1, wherein a backup battery is coupled to the power circuit, the backup battery is activated by the controller when the power failure detection circuit detects an emergency power off condition.

17. The lighting apparatus of claim 1, wherein the controller performs the mode switch when the wall switch is a simple on/off switch.

* * * * *